US009108823B2

(12) United States Patent
Washio et al.

(10) Patent No.: US 9,108,823 B2
(45) Date of Patent: Aug. 18, 2015

(54) ELEVATOR SAFETY CONTROL DEVICE

(75) Inventors: Kazunori Washio, Tokyo (JP); Masafumi Iwata, Tokyo (JP); Takuya Ishioka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 601 days.

(21) Appl. No.: 13/522,785

(22) PCT Filed: Mar. 12, 2010

(86) PCT No.: PCT/JP2010/054230
§ 371 (c)(1),
(2), (4) Date: Jul. 18, 2012

(87) PCT Pub. No.: WO2011/111223
PCT Pub. Date: Sep. 15, 2011

(65) Prior Publication Data

US 2012/0292136 A1 Nov. 22, 2012

(51) Int. Cl.
*B66B 1/28* (2006.01)
*B66B 5/00* (2006.01)

(52) U.S. Cl.
CPC ..... *B66B 5/0031* (2013.01)

(58) Field of Classification Search
CPC .... B66B 1/3446; B66B 5/0006; B66B 5/0031
USPC ..... 187/247, 248, 391, 393, 414
See application file for complete search history.

(56) References Cited

U.S. PATENT DOCUMENTS

| | | | | |
|---|---|---|---|---|
| 4,345,670 | A * | 8/1982 | Kaneko et al. | 187/248 |
| 4,350,225 | A * | 9/1982 | Sakata et al. | 187/248 |
| 4,473,135 | A * | 9/1984 | Yonemoto | 187/248 |
| 5,387,769 | A * | 2/1995 | Kupersmith et al. | 187/248 |
| 6,173,814 | B1 * | 1/2001 | Herkel et al. | 187/288 |
| 6,286,628 | B1 * | 9/2001 | Lee | 187/393 |

(Continued)

FOREIGN PATENT DOCUMENTS

| | | |
|---|---|---|
| DE | 199 27 657 A1 | 1/2001 |
| JP | 2 276784 | 11/1990 |

(Continued)

OTHER PUBLICATIONS

Office Action issued Sep. 3, 2013 in Japanese Application No. 2012-504248 (With English Translation).

(Continued)

*Primary Examiner* — Anthony Salata
(74) *Attorney, Agent, or Firm* — Oblon, McClelland, Maier & Neustadt, L.L.P.

(57) ABSTRACT

An elevator safety control device realizing suppression in increase in cost and labor hour of installation and maintenance without deteriorating safety of normal safety control functions even when a plurality of safety control functions are provided. The elevator safety control device includes an independence assurance unit assuring independence of a safety control function. The independence assurance unit assures independence of each of the safety control functions by monitoring whether or not the safety control function accesses a memory other than a permitted region. When the independence assurance unit detects an access to the memory other than the permitted region by a predetermined safety control function, the elevator safety control device stops a car.

35 Claims, 9 Drawing Sheets

(56) References Cited

U.S. PATENT DOCUMENTS

| | | | | |
|---|---|---|---|---|
| 6,470,430 | B1 | 10/2002 | Fischer et al. | |
| 7,415,476 | B2 | 8/2008 | Borrowman | |
| 7,419,032 | B2 * | 9/2008 | Yamakawa | 187/247 |
| 7,503,432 | B2 * | 3/2009 | Chida | 187/248 |
| 7,896,135 | B2 * | 3/2011 | Kattainen et al. | 187/248 |
| 2001/0021966 | A1 | 9/2001 | Kawasaki et al. | |
| 2007/0125604 | A1 | 6/2007 | Ohira | |
| 2010/0187047 | A1 * | 7/2010 | Gremaud et al. | 187/351 |
| 2011/0036667 | A1 | 2/2011 | Ueda et al. | |
| 2012/0279809 | A1 * | 11/2012 | Ogava et al. | 187/394 |

FOREIGN PATENT DOCUMENTS

| | | | |
|---|---|---|---|
| JP | 2001-325150 | | 11/2001 |
| JP | 2002 91826 | | 3/2002 |
| JP | 2002 538536 | | 11/2002 |
| JP | 2004 137055 | | 5/2004 |
| KR | 10-2010-0129340 | A | 12/2010 |
| WO | 2005 115898 | | 12/2005 |
| WO | 2006 090470 | | 8/2006 |
| WO | 2007 057973 | | 5/2007 |
| WO | 2009 157085 | | 12/2009 |

OTHER PUBLICATIONS

Office Action issued Nov. 11, 2013 in German Patent Application No. 11 2010 005 384.7 (with English translation).

International Preliminary Report on Patentability Issued Oct. 2, 2012 in PCT/JP10/54230 Filed Mar. 12, 2010.

International Search Report Issued Jul. 20, 2010 in PCT/JP10/54230 Filed Mar. 12, 2010.

Combined Chinese Office Action and Search Report issued Mar. 4, 2014 in Patent Application No. 201080064973.1 (with English language translation).

Office Action issued Jul. 22, 2013 in Korean Patent Application No. 10-2012-7022851 (with partial English language translation).

* cited by examiner

F I G . 3
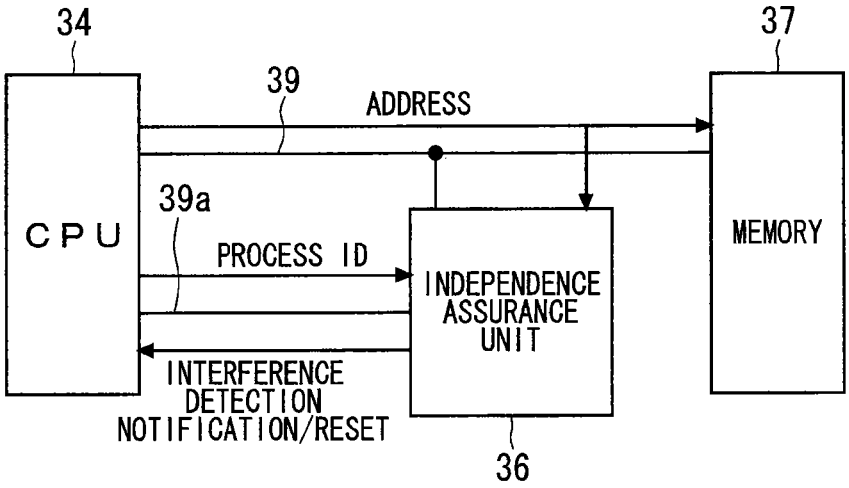
F I G . 4
| PROCESS ID | ACCESSIBLE REGION |
|---|---|
| 1 | 0000～1000 |
| 2 | 1001～2000 |
| ⋮ | ⋮ |
| n | EFFF～FFFF |
F I G . 5
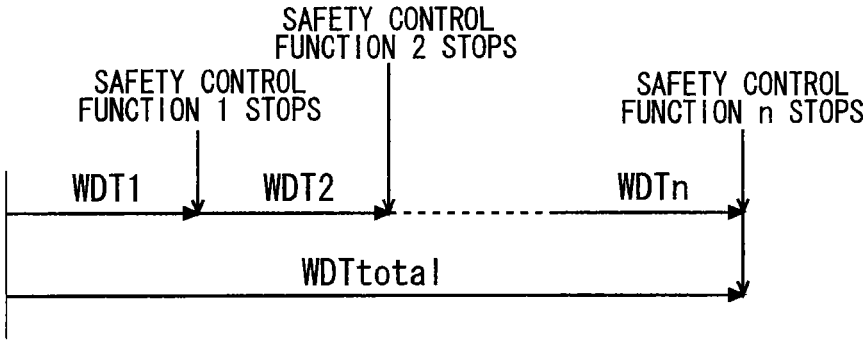

F I G . 9

| REAL ADDRESS | LOGICAL ADDRESS | ACCESS RIGHT | ACCESSIBLE PROCESS ID |
|---|---|---|---|
| R1 | L1 | read | 1 |
| R2 | L2 | write | 1 |
| R3 | L3 | write | 1 |
| R4 | L4 | write | 2 |
| R5 | L5 | read | 2 |
| R6 | L6 | read | 2 |
| R7 | L7 | r/w | 2 |
| R8 | L8 | write | 3 |
| R9 | L9 | read | 3 |
| R10 | L10 | — | — |
| ⋮ | ⋮ | ⋮ | ⋮ |
| Rmm | Lmm | r/w | n |

ELEVATOR SAFETY CONTROL DEVICE

TECHNICAL FIELD

The present invention relates to an elevator safety control device for controlling operation of an elevator from the safety viewpoint on the basis of a sensor signal from a sensor.

BACKGROUND ART

In a conventional elevator safety control device, in the case of providing a plurality of safety control functions, substrates or devices of the same number as that of the safety control functions have to be prepared (refer to, for example, Patent Literature 1). In one substrate or one device, a logic unit including a processor (CPU) and a memory is formed.

In a technique according to Patent Literature 1, a monitor substrate (monitor) for monitoring the position and speed of a car and a brake control substrate (brake controller) for controlling a brake device when second control operation is performed are provided. That is, in the technique according to Patent Literature 1, two safety control functions are provided, and substrates (devices) in which the logic units are formed, of the same number as that of the safety control functions are disposed.

PRIOR ART LITERATURE

Patent Literature

Patent Literature 1: WO 2007-057973

SUMMARY OF THE INVENTION

Problems to be Solved by the Invention

As described above, in the elevator safety control device according to Patent Literature 1, a plurality of substrates or devices of the same number as that of safety control functions have to be prepared. Therefore, when a plurality of safety control functions are realized in the elevator safety control device according to Patent Literature 1, the cost of the elevator safety control device becomes high, and labor hour of installation and maintenance of the elevator safety control device increases.

As a method of solving the problem, there is a method of providing one substrate or device with a plurality of safety control functions. However, when one substrate or device is simply provided with a plurality of safety control functions, in the case where one of the safety control functions fails, it exerts an influence on the other safety control functions, and there is the possibility that safety of the normal safety control functions is impaired.

An object of the present invention, therefore, is to provide an elevator safety control device in which increase in cost and labor hour of installation and maintenance can be suppressed and safety of normal safety control functions are not impaired even when a plurality of safety control functions are provided.

Means for Solving the Problems

To achieve the object, an elevator safety control device according to claim 1 according to the present invention is an elevator safety control device controlling stop of a car, including: an input unit receiving a signal on a state of an elevator as an input value; a logic unit including a CPU (Central Processing Unit) performing computation on safety control of the elevator by executing computation on a plurality of safety control functions by independent programs by using the input value, and a memory; and an independence assurance unit assuring independence of the safety control function so that the safety control functions do not exert influence on one another. The independence assurance unit assures independence of each of the safety control functions by monitoring whether or not the safety control functions accesses the memory other than a permitted region, and when the independence assurance unit detects an access to the memory other than the permitted region by a predetermined one of the safety control functions, the elevator safety control device stops the car.

An elevator safety control device according to claim 3 is an elevator safety control device controlling stop of a car and includes: an input unit receiving a signal on a state of an elevator as an input value; a logic unit including a CPU (Central Processing Unit) performing computation on safety control of the elevator by executing computation on a plurality of safety control functions by each of independent programs by using the input value; and an independence assurance unit assuring independence of the safety control function so that the safety control functions do not exert influence on one another. The independence assurance unit assures independence of the safety control function by monitoring whether or not computation process time of the safety control function exceeds preset specified time. When the independence assurance unit detects that the computation process time exceeds the specific time, the elevator safety control device stops the car.

Effects of the Invention

In the elevator safety control device according to claim 1 of the present invention, the independence assurance unit assures independence of each of safety control functions by monitoring whether or not the safety control function accesses a memory other than a permitted region. When the independence assurance unit detects an access to the memory other than the permitted region, of a predetermined one of the safety control functions, the elevator safety control device stops a car.

In the elevator safety control device according to claim 3, the independence assurance unit assures independence of each of safety control functions by monitoring whether or not computation process time of the safety control function exceeds preset specified time. When the independence assurance unit detects that the computation process time exceeds the specified time, the elevator safety control device stops the car.

Therefore, without exerting an influence of one of safety control functions on other safety control functions, a single elevator safety control device (safety control substrate) can be provided with a plurality of safety control functions. Thus, the cost on safety control of an elevator can be reduced, and installation and maintenance are performed easily.

BRIEF DESCRIPTION OF THE DRAWINGS

FIG. 3 is a diagram showing connection relations of a CPU 34, an independence assurance unit 36, and a memory 37 according to the first embodiment.

FIG. 4 is a diagram for explaining a memory interference monitoring function of the independence assurance unit 36 according to the first embodiment.

FIG. 5 is a diagram for explaining an execution time monitoring function of the independence assurance unit 36 according to the first embodiment.

FIG. 9 is a diagram illustrating an assignment table used in the memory interference monitoring function of the independence assurance unit 36 according to a third embodiment.

EMBODIMENT FOR CARRYING OUT THE INVENTION

Hereinafter, embodiments of the present invention will be concretely described with reference to the drawings.

First Embodiment

Figure 1:
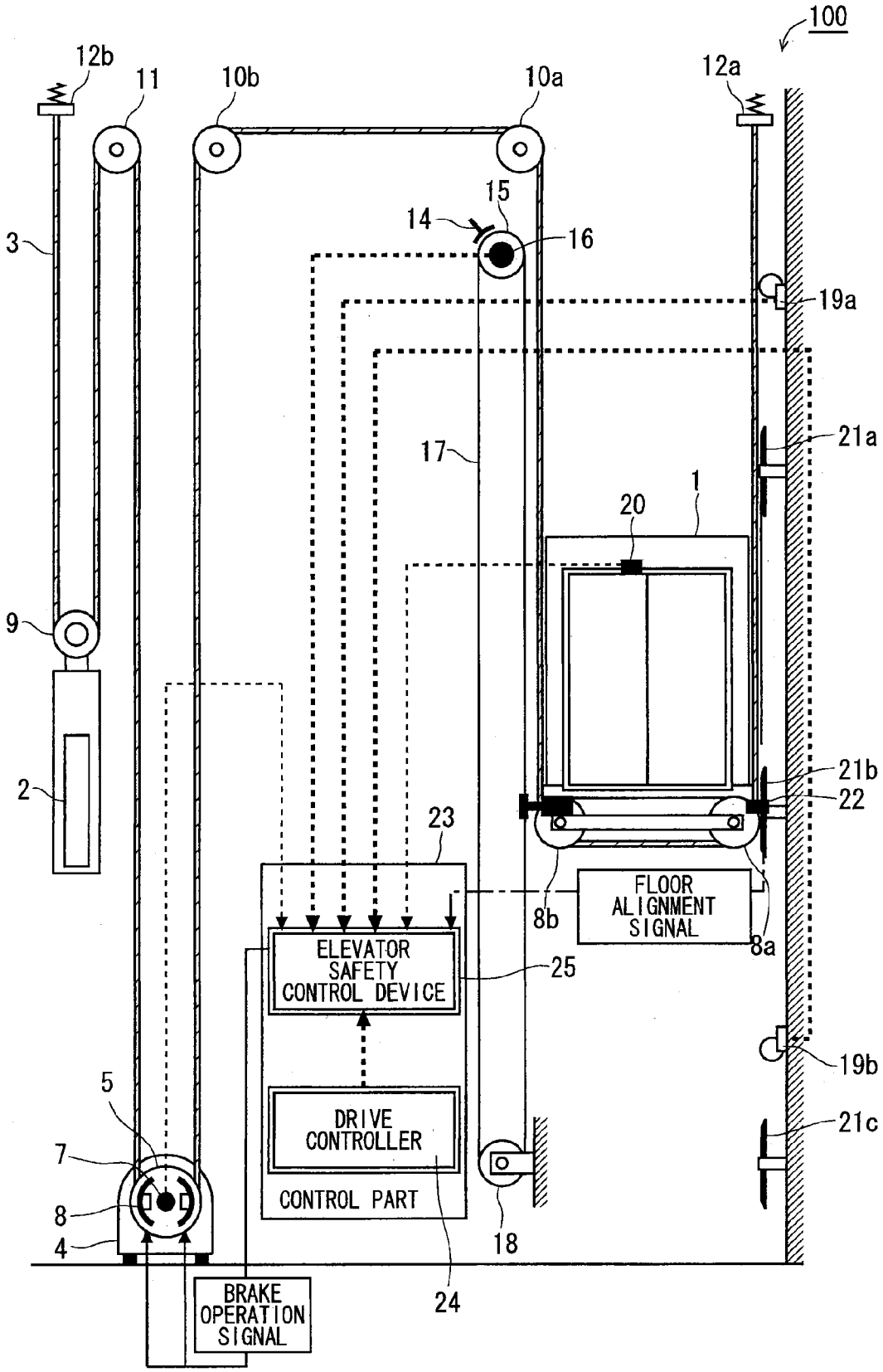
FIG. 1 is a diagram showing the configuration of an elevator device 100 according to the present invention.

FIG. 1 is a diagram showing the configuration of an elevator device 100 according to a first embodiment of the present invention. In FIG. 1, a car 1 and a balance weight 2 are suspended by suspending means 3 in a hoistway. The suspending means 3 includes a plurality of ropes or belts.

In a lower part of the hoistway, a hoisting machine 4 for making the car 1 and the balance weight 2 lifted are provided. The hoisting machine 4 has a drive sheave 5 on which the suspending means 3 is wound, a hoisting machine motor for generating drive torque to rotate the drive sheave 5, a hoisting machine brake 6 as braking means which generates braking torque to brake the rotation of the drive sheave 5, and a hoisting machine encoder 7 generating a signal according to the rotation of the drive sheave 5.

As the hoisting machine brake 6, for example, an electromagnetic brake device is used. In the electromagnetic brake device, a brake shoe is pressed against a braking surface by spring force of a braking spring to brake the rotation of the drive sheave 5, and the car 1 is braked. By exciting an electromagnet, the brake shoe is detached from the braking surface, and the braking force is cancelled. Further, a braking force applied by the hoisting machine brake 6 is changed according to the value of current flowing in a brake coil of the electromagnet.

The car 1 is provided with a pair of car pulleys 8*a* and 8*b*. The balance weight 2 is provided with a counterweight pulley 9. In an upper part of the hoistway, car pulleys 10*a* and 10*b* and a counterweight return pulley 11 are provided. One end of the suspending means 3 is connected to a first rope stop 12*a* provided in an upper part of the hoistway. The other end of the suspending means 3 is connected to a second rope stop 12*b* provided in an upper part of the hoistway.

The suspending means 3 is wound on, sequentially from one end side, the car pulleys 8*a* and 8*b*, the car return pulleys 10*a* and 10*b*, the drive sheave 5, the counterweight return pulley 11, and the counterweight pulley 9. That is, the car 1 and the counterweight 2 are suspended in the hoistway by the "2:1 roping method".

In the upper part of the hoistway, a governor 14 is installed. The governor 14 includes a governor sheave 15 and a governor encoder 16 for generating a signal according to the rotation of the governor sheave 15. A governor rope 17 is looped around the governor sheave 15. Both ends of the governor rope 17 are connected to an operation lever of an emergency stop device mounted on the car 1. The lower end of the governor rope 17 is looped around a tension pulley 18 disposed in a lower part of the hoistway. When the car 1 is moved up or down, the governor rope 17 is circulated and the governor sheave 15 is rotated at rotation speed according to travel speed of the car 1.

In an upper part of the hoistway, an upper reference-position switch 19*a* for detecting the position of the car 1 is provided. In a lower part of the hoistway, a lower reference-position switch 19*b* for detecting the position of the car 1 is provided. The car 1 is provided with a switch operating member (cam) for operating the reference-position switches 19*a* and 19*b*.

A car-door switch 20 for detecting opening/closing of a car door is provided on the car 1. A landing-door switch for detecting opening/closing of a landing door is provided for the landing at each floor. Further, in the hoistway, a plurality of floor-alignment plates 21*a* to 21*c* for detecting that the car 1 is located at a position (in a door zone) in which a passenger can safely board and deboard the car 1 are provided. The car 1 is provided with a floor-alignment sensor 22 for detecting the floor-alignment plates 21*a* to 21*c*.

Each of the hoisting machine encoder 7, the governor encoder 16, the reference-position switches 19*a* and 19*b*, the car-door switch 20, the landing-door switches, and the floor-alignment sensor 22 is a sensor which generates a signal according to the state of the car 1.

In the hoistway, a control board 23 is installed. In the control board 23, a driving controller (driving control substrate) 24 as an operation controller and an elevator safety control device (safety control substrate) 25 are provided. The elevator safety control device (safety control substrate) 25 can control stop of the car 1.

In the elevator device, to secure safety, monitoring/controls are executed on the system from a plurality of viewpoints. To execute the monitoring/controls, the safety control substrate 25 is provided with a plurality of safety control functions. That is, the safety control substrate 25 executes computations on the safety control functions by independent programs (software), respectively, thereby realizing the safety controls from the plurality of viewpoints of the elevator device. The safety control functions include, for example, a brake control function and an overspeed monitoring function.

The drive controller 24 controls the operation of the hoisting machine 4, that is, the operation of the car 1. The drive controller 24 also controls travel speed of the car 1 on the basis of a signal from the hoisting machine encoder 7. Further, the drive controller 24 outputs a brake operation instruction for keeping the car 1 stopped at the landing and a brake release instruction for allowing the travel of the car 1 to the brake control function.

The brake control function as one of the safety control functions obtains the brake operation instruction from the drive controller 24 and, in accordance with the operation instruction, outputs a brake operation signal to the hoisting machine brake 6. The brake control function can control the braking force (braking torque) generated by the hoisting machine brake 6 by controlling the current passed to the brake coil of the hoisting machine brake 6. The braking force generated by the hoisting machine brake 6 is reduced by increasing the value of the current to the brake coil. When the current value exceeds a predetermined value, the braking force becomes zero. On the other hand, when the value of the current to the brake coil is reduced, the braking force is increased. When the current value becomes zero, the braking force becomes maximum.

The brake control function uses a signal from the floor-alignment sensor 22 to determine whether or not the car 1 is in the landing position. Further, the brake control function uses signals from the car-door switch 20 and the landing-door switch to determine an open/close state of each of the car door and the landing door. Further, the brake control function uses a signal from the hoisting machine encoder 7 to determine whether or not the car 1 travels.

The brake control function detects a state where at least any one of the car door and the landing door is open although the car 1 has not arrived at the landing position and a state where at least any one of the car door and the landing door is open although the car 1 is traveling, and outputs a brake operation instruction. Specifically, when the door-open travel state is detected, the brake control function brakes the drive sheave 5 by the hoisting machine brake 6 and also stops the hoisting-machine motor to forcibly stop the car 1.

Signals from the governor encoder 16 and the reference-position switches 19*a* and 19*b* are input to an overspeed monitoring function as one of the safety control function. The overspeed monitoring function uses the signals from the governor encoder 16 and the reference-position switches 19*a* and 19*b* to obtain the position and speed of the car 1 independently of the drive controller 24 and monitors whether or not the speed of the car 1 reaches a predetermined overspeed level. The overspeed level is set as an overspeed monitoring pattern which changes according to the position of the car 1.

When the speed of the car 1 reaches the overspeed level, the overspeed monitoring function transmits a forcible stop signal to the brake control function. When the forcible stop signal is received, the brake control function brakes the drive sheave 5 by the hoisting machine brake 6 and also stops the hoisting machine motor to forcibly stop the car 1.

Each of the drive controller 24 and the elevator safety control device 25 has an independent microcomputer. The function of the drive controller 24 and the function of the elevator safety control device 25 are realized by the microcomputers. Operations of the safety control functions (such as the brake control function and the overspeed monitoring function) provided for the safety control device 25 are executed by independent programs (software).

Although the different names of "elevator safety control device" and "safety control substrate" are used for the elevator safety control device 25 in the application, they refer to the same elevator safety control device 25.

In the present invention, the single elevator safety control device (safety control substrate) 25 is provided with a plurality of various safety control functions. However, in the case of simply providing the single substrate (device) 25 with a plurality of safety control functions, when one of the safety control functions fails, there is the possibility that the other safety control function is lost and a trouble occurs in the elevator safety control (that is, independence of each of the safety control functions cannot be assured). It is consequently necessary to assure the independence of each of the safety control functions so that each of the safety control functions does not exert an influence on the other safety control functions.

Figure 2:
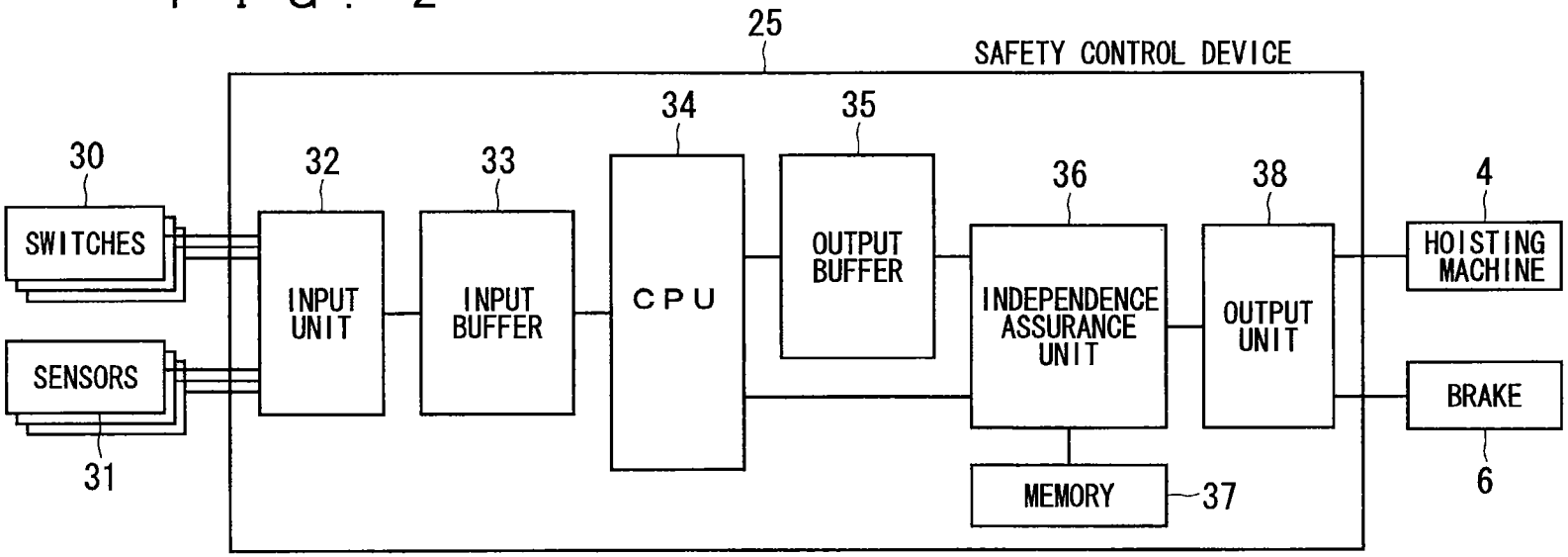
FIG. 2 is a block diagram showing the configuration of an elevator safety control device 25 according to a first embodiment.

In the embodiment, therefore, the elevator safety control device (safety control substrate) 25 having the configuration shown in FIG. 2 is provided. FIG. 2 is a block diagram showing the configuration of the elevator safety control device (safety control substrate) 25 shown in FIG. 1. The elevator safety control device 25 shown in FIG. 2 includes an independence assurance unit 36 assuring independence of a plurality of safety control functions.

As shown in FIG. 2, the elevator safety control device 25 has an input unit 32, an input buffer 33, a CPU (Central Processing Unit) 34, an output buffer 35, the independence assurance unit 36, a memory 37, and an output unit 38. In other words, on a single safety control substrate 25, the input unit 32, the input buffer 33, the CPU (Central Processing Unit) 34, the output buffer 35, the independence assurance unit 36, the memory 37, and the output unit 38 are mounted.

In FIG. 2, the input unit 32 is connected to the input buffer 33, and the input buffer 33 is connected to the CPU 34. The CPU 34 is connected to each of the output buffer 35 and the independence assurance unit 36. The independence assurance unit 36 is connected to each of the output buffer 35, the memory 37, and the output unit 38. The input unit 32 is connected to each of external components 30 and 31 of the safety control substrate 25, and the output unit 38 is connected to each of the external components 4 and 6 of the safety control substrate 25.

To the input unit 32, a signal on the state of the entire elevator system including the car 1 (hereinbelow, called the state of the elevator) is input as an input value. As described above, to monitor/detect the state of the elevator, the various switches 19*a* and 19*b* and the various sensors 16 and the like exist. In FIG. 2, the various switches are collectively illustrated as the switches 30, and the various sensors are collectively illustrated as the sensors 31. To the input unit 32, output signals from the switches 30 and output signals (the signal regarding the state of the elevator) from the sensors 31 are input as input values.

In the input unit 32, pulse signals such as encoder signals are counted to obtain numerical values. The input unit 32 also performs comparison between duplicated input values, comparison between the input value and a signal from a reference sensor (not shown), and the like. In the case where mismatch is detected as a result of the comparison in the input unit 32, the mismatch is transmitted to the CPU 34 as a component of the logic unit. The input values supplied to the input unit 32 are stored in the input buffer 33.

The CPU 34 reads the input values of the sensors 31 and the switches 30 from the input buffer 33. The CPU 34 performs arithmetic operation necessary for a plurality of safety controls on the elevator. That is, the CPU 34 executes the arithmetic operation on the plurality of safety control functions using the input values by independent programs (software). In such a manner, the safety control on the elevator is realized.

The independence assurance unit 36 provides assuring functions of assuring independence of a plurality of safety control functions. One of the assuring functions is a memory interference monitoring function. Each of the safety control functions can access only a determined region in the memory 37 as a component of the logic unit. The memory interference monitoring function is a function of monitoring whether or not each of the safety control functions accesses the memory 37 other than the accessible region. The memory interference monitoring function will be described concretely later with reference to FIG. 3.

FIG. 3 is a block diagram showing connection relations of the CPU 34, the memory 37, and the independence assurance unit 36.

As shown in FIG. 3, the CPU 34 and the memory 37 are connected to each other via a bus 39, and the independence assurance unit 36 is interposed in the bus 39. The CPU 34 and the independence assurance unit 36 are connected to each other via a communication line 39*a*.

For example, the CPU 34 notifies the independence assurance unit 36 of a process ID of the safety control function currently executing operation in the CPU 34 via the communication line 39*a*. The process ID is information for identifying the safety control function. On the other hand, the independence assurance unit 36 notifies the CPU 34 via the communication line 39*a* of determination results of the independence assurance unit 36 (as an example, a memory interference monitoring result, an execution time monitoring result, and the like), various instructions (such as a reset process instruction, for one example), and the like.

The CPU 34 accesses a predetermined address in the memory 37 at the time of computing process of the safety control function. The independence assurance unit 36 obtains information on the region in the memory 37 (that is, address information), to be accessed by the safety control function via the bus 39.

The memory interference monitoring function in the independence assurance unit 36 checks whether the obtained address information is in a preliminarily assigned range in the memory 37 or not.

Concretely, in the independence assurance unit 36, an assignment table as shown in FIG. 4 is preliminarily set. The assignment table is constructed by "process ID" and "accessible region" in the memory 37, which is allowed to be accessed by a safety control function having the process ID at the time of computation process of the safety control function.

The independence assurance unit 36 having the memory interference monitoring function monitors whether the memory 37 other than the region which is allowed to the safety control function is accessed or not by using the information (process ID and address information) obtained from the CPU 34 and the assignment table. That is, the independence assurance unit 36 assures independence of the safety control function by the monitoring.

As described above, by comparing the information obtained from the CPU 34 and the assignment table, the independence assurance unit 36 monitors whether each of the safety control functions accesses the memory 37 other than the allowed region or not.

It is now assumed that the independence assurance unit 36 detects that, in a safety control function currently executing operation, the CPU 34 accesses the memory 37 other than an address to which the safety control function is allowed to access (that is, presence of memory interference is detected, in other words, independence of the safety control function cannot be assured). In this case, the independence assurance unit 36 notifies the CPU 34 of the detection of the memory interference via the communication line 39*a*. The elevator safety control device 25 puts itself in the reset state (that is, the power supply of the elevator safety control device 25 is reset).

When the power supply of the elevator safety control device 25 is reset, an output from the elevator safety control device 25 becomes "low (or zero)", and power supply to the hoisting machine 4 and the brake 6 is interrupted. Accordingly, the car 1 enters a stop state.

The independence assurance unit 36 according to the embodiment has not only the memory interference monitoring function but also an execution time monitoring function. The execution time monitoring function is a function of monitoring each computation process time in which individual safety control function is executed and/or total computation process time in which all of the safety control functions are executed.

The independence assurance unit 36 may have only either the memory interference monitoring function and the execution time monitoring function. In the following description, the independence assurance unit 36 has both of the memory interference monitoring function and the execution time monitoring function. In the execution time monitoring function to be described hereinafter, both of the individual computation process time and the total computation process time are monitored.

By monitoring whether the computation process time by a safety control function exceeds preset specified time or not, the independence assurance unit 36 assures independence of the safety control function. When the independence assurance unit 36 detects that the computation process time of the safety control function exceeds the specified time (when the independence of the safety control function cannot be assured), the elevator safety control device 25 stops the car 1.

The details of the execution time monitoring function will be described with reference to FIG. 5.

The independence assurance unit 36 has a plurality of watchdog timers WDT1, WDT2, . . . , WDTn, and WDTtotal. For each of the watchdog timers WDT1, WDT2, . . . , WDTn, and WDTtotal, specified time (time limit) is preset independently.

The watchdog timers WDT1, WDT2, . . . , WDTn are prepared for respective safety control functions (in the description, "n" pieces of safety control functions exist and, therefore, "n" pieces of watchdog timers exist). Therefore, each specified time is determined in correspondence with each safety control function.

Simultaneously with start of computation of a safety control function, the independence assurance unit 36 starts any of the watchdog timers WDT1, WDT2, . . . , and WDTn corresponding to the safety control function. Further, the independence assurance unit 36 starts the watchdog timer WDTtotal on start of computation in a safety control function which starts the computation process first in a plurality of safety control functions.

At the end of the computation of the safety control function, the independence assurance unit 36 stops the watchdog timer corresponding to the safety control function in the watchdog timers WDT1, WDT2, . . . , and WDTn. After completion of all of the safety control functions (in the description, after the "n" pieces of safety control functions are completed), that is, after completion of computation of the last safety control function, the independence assurance unit 36 stops the watchdog timer WDTtotal.

As described above, specified time is set in each of the watchdog timers WDT1, WDT2, . . . , WDTn, and WDTtotal. When there is even one watchdog timer which is not stopped within the specified time in the watchdog timers WDT1, WDT2, . . . , WDTn, and WDTtotal, the independence assurance unit 36 detects that the computation process time of the safety control function exceeds the specified time. By the detection, the independence assurance unit 36 notifies the CPU 34 of the detection, and the elevator safety control device 25 resets itself (that is, the car 1 is stopped).

For example, the independence assurance unit 36 monitors, for each of the safety control functions, whether or not the individual computation process time exceeds the specified time set in the watchdog timer WDT1, WDT2, . . . , or WDTn corresponding to the safety control function. The individual computation process time is time required for computation for an individual safety control function. When the independence assurance unit 36 detects that the individual computation process time exceeds the specified time in any of the safety control functions (that is, when any one of the watchdog timers WDT1, WDT2, . . . , and WDTn is not stopped within the specified time), the elevator safety control device 25 stops the car 1.

The independence assurance unit 36 monitors whether or not the total computation process time of all of the safety control functions exceeds the specified time set for the watchdog timer WDTtotal. When the independence assurance unit 36 detects that the total computation process time exceeds the specified time (that is, the watchdog timer WDTtotal is not stopped within the specified time), the elevator safety control device 25 stops the car 1.

The independence assurance unit 36 monitors whether or not a failure in any safety control function exerts an influence on the other safety control functions by the memory interference monitoring function and the execution time monitoring function and, in the case where the influence is likely to be exerted, stops the safety control device 25 reliably (that is, stops the car 1).

Figure 6:
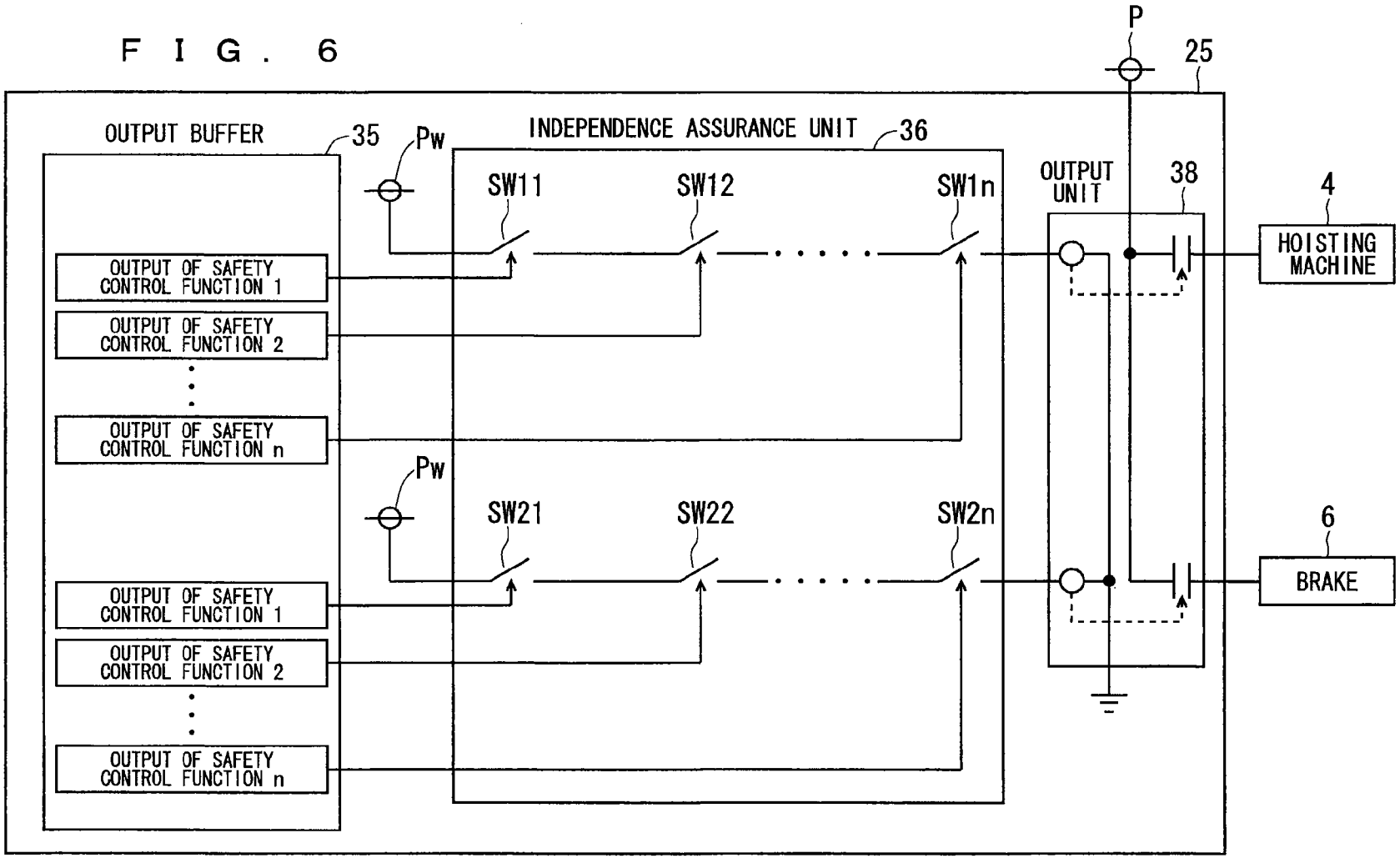
FIG. 6 is a diagram showing internal configurations and connection relations of the independence assurance unit 36, an output buffer 35, and an output unit 38 of the first embodiment.

In FIG. 2, the output buffer 35 stores, as output values, computation results of the safety control functions by the CPU 34. FIG. 6 is a diagram showing the relations among the output buffer 36, the independence assurance unit 36, and the output unit 38.

In FIG. 6, computation results of "n" pieces of safety control functions are stored in the output buffers 35. In the independence assurance unit 36, systems in which a plurality of switches are connected in series exist only by the number corresponding to that of objects to be controlled. In the configuration illustrated in FIG. 6, objects to be controlled are two objects of the hoisting machine 4 and the brake 6. Therefore, two systems are provided in the independence assurance unit 36.

In one of the systems, switches SW11, SW12, . . . , and SW1*n* are connected in series. In the other system, switches SW21, SW22, . . . , and SW2*n* are connected in series. A power supply Pw is connected to one end of each of the systems.

To the switches SW11 and SW21, a computation result of a first safety control function is input from the output buffer 35. To the switches SW12 and SW22, a computation result of a second safety control function is input from the output buffer 35. To the switches SW1*n* and SW2*n*, a computation result of an "n"th safety control function is input from the output buffer 35. An output of one of the systems is connected to the hoisting machine 4 via the output unit 38, and an output of the other system is connected to the brake 6 via the output unit 38.

In FIG. 6, when any of the switches SW11 to SW1*n* enters an OFF state, the output unit 38 stops supply of a power P to the hoisting machine 4. When any of the switches SW21 to SW2*n* enters an OFF state, the output unit 38 stops supply of the power P to the brake 6.

When it is determined that the computation result of the safety control function is normal in the operation of the elevator (when the result shows safety of the elevator), the computation result is input to the switches SW11 to SW1*n* and the switches SW21 to SW2*n*, and the switches SW11 to SW1*n* and the switches SW21 to SW2*n* enters an ON state.

On the other hand, when it is determined that the computation result of the safety control function is abnormal in the operation of the elevator (when the result does not show safety of the elevator), the computation result is input to the switches SW11 to SW1*n* and the switches SW21 to SW2*n*, and the switches SW11 to SW1*n* and the switches SW21 to SW2*n* enters an OFF state. In the following description, the computation result determined as abnormal in the operation of the elevator will be called a computation result of "error".

Stop of supply of the power P to the hoisting machine 4 and the brake 6 means stop of the car 1.

As understood from the description using FIG. 6, when the independence assurance unit 36 detects that the computation result of any one of the safety control functions is "error", the elevator safety control device 25 stops the car 1.

As the switches SW11 to SW1*n* and the switches SW21 to SW2*n*, transistors or semiconductor switches such as MOSFET may be used. The switches may be realized by AND circuits (IC) or software.

The supply or interruption of the power P to the hoisting machine 4 and the brake 6 in the output unit 38 is realized by forming a relay or contactor connected to the power P in the output unit 38 (see FIG. 6).

The car 1 is stopped in the following modes.

When the independence assurance unit 36 detects that the computation result of any of the safety control functions shows "error" or detects that independence among the safety control functions cannot be assured, the elevator safety control device 25 immediately stops the car 1. Concretely, the safety control device 25 notifies the drive controller 24 of an instruction of immediate stop and, by control of the drive controller 24, the car 1 is immediately stopped. The configuration of FIG. 6 is a configuration adapted to the mode of the immediate stop.

When the independence assurance unit 36 detects that the computation result of any of the safety control functions shows "error" or detects that independence among the safety control functions cannot be assured, the elevator safety control device 25 moves the car 1 to the floor closest to the position of the car 1 at the time of the detection and stops the car 1 at the closest floor. Concretely, the safety control device 25 notifies the drive controller 24 of a closest-floor stop instruction of stopping the car 1 at the closest floor and, by control of the drive controller 24, the car 1 is stopped at the closest floor.

The elevator safety control device 25 determines whether or not the car 1 has arrived at the closest floor within predetermined time since stop of the car 1 at the closest floor is instructed (closest-floor stop instruction). When the elevator safety control device 25 detects that the car 1 did not arrive at the closest floor within the predetermined time, the safety control device 25 immediately emergency-stops the car 1 after lapse of the predetermined time. Concretely, immediately after lapse of the predetermined time, the safety control device 25 sends an immediate stop instruction to the drive controller 24 and, by the control of the drive controller 24, the car 1 is immediately stopped.

For example, the elevator safety control device 25 has a watchdog timer (not shown) in which the predetermined time (time limit) can be set. As the predetermined time, various values can be set in the timer. The elevator safety control device 25 estimates predetermined time that the car 1 arrives at the closest floor and sets the estimated predetermined time in the watchdog timer.

The elevator safety control device 25 starts the watchdog timer simultaneously with the closest-floor stop instruction. It is assumed that a message that the car 1 stops at the closest floor is not transmitted to the watchdog timer within predetermined time after start of the timer. In this case, the watchdog timer operates the function of the watchdog timer immediately after lapse of the predetermined time and, by the operation, the elevator safety control device 25 emergency-stops the car 1.

Next, the operation of the elevator safety control device 25 will be described with reference to the flowchart of FIG. 7.

First, the CPU 34 performs computation of a predetermined safety control function (step S1). At this time, the independence assurance unit 36 monitors whether independence is assured or not by the memory interference monitoring function (step S2). Specifically, the CPU 34 executes the predetermined safety control function, and the independence assurance unit 36 monitors whether or not the CPU 34 accesses an address other than an address which is allowed to the predetermined safety control function in the memory 37 (that is the presence or absence of memory interference) (step S2).

It is assumed that the independence assurance unit 36 detects the presence of memory interference (YES in step S2). In this case, the elevator safety control device 25 stops the car 1 in any of the above-described modes (step S8).

On the other hand, it is assumed that the independence assurance unit 36 determines the absence of memory interference ("NO" in step S2). In this case, the independence assurance unit 36 makes determination by the operation of the execution time monitoring function (step S3).

In step S3, the independence assurance unit 36 determines whether the individual computation process time as computation process time of the predetermined safety control function exceeds specified time or not. The specified time is set in the watchdog timer WDTi corresponding to the predetermined safety control function.

It is assumed that the independence assurance unit 36 detects that computation of a predetermined safety control function has not been finished within specified time ("YES" in step S3). In this case, the elevator safety control device 25 stops the car 1 in any of the above-described modes (step S8).

On the other hand, it is assumed that the independence assurance unit 36 detects that computation of a predetermined safety control function is finished within specified time ("NO" in step S3). In this case, the independence assurance unit 36 executes step S4.

When independence of a predetermined safety control function is assured in steps S2 and S3 ("NO" in step S2 and "NO" in step S3), an computation result of a predetermined safety control function is output from the CPU 34 toward the output buffer 35.

FIG. 6 shows a state where the power P is supplied to the hoisting machine 4 and the brake 6. That is, the switches SW11 to SW1*n* and the switches SW21 to SW2*n* of the independence assurance unit 36 are in the on state. In this state, the independence assurance unit 36 monitors whether the computation result of the predetermined safety control function stored in the output buffer 35 shows a normal value or not (step S4).

It is assumed that the independence assurance unit 36 detects that the computation result is "error" (a result of determination of "abnormal state" from the viewpoint of safety of the elevator) ("YES" in step S4). It means that the switch in the independence assurance unit 36, which corresponds to the output of the computation result is turned off. In this case, the elevator safety control device 25 stops the car 1 in any of the above-described modes (step S8).

On the other hand, it is assumed that the independence assurance unit 36 detects that the computation result is normal (a result of determination of "normal state" from the viewpoint of safety of the elevator) ("NO" in step S4). In this case, the elevator safety control device 25 determines whether execution of computation of all of the safety control functions provided has completed or not (step S5).

In the case where computation of all of the safety control functions is not completed ("NO" in step S5), the elevator safety control device 25 selects one of the safety control functions which are not computed yet and repeatedly executes the operations from step S1 on the selected safety control function.

On the other hand, when computation of all of the safety control functions is completed ("YES" in step S5), the independence assurance unit 36 determines whether the total computation process time of all of the safety control functions exceeds the specified time or not (step S6). The specified time is set in the watchdog timer WDTtotal.

It is assumed that the independence assurance unit 36 detects that computation of all of the safety control functions is not finished within the specified time ("YES" in step S6). In this case, the elevator safety control device 25 stops the car 1 by any of the above-described modes (step S8).

It is assumed that the independence assurance unit 36 detects that computation of all of the safety control functions is finished within the specified time ("NO" in step S6). In this case, the normal operation of the elevator by the drive controller 24 is continued (step S7).

Figure 7:
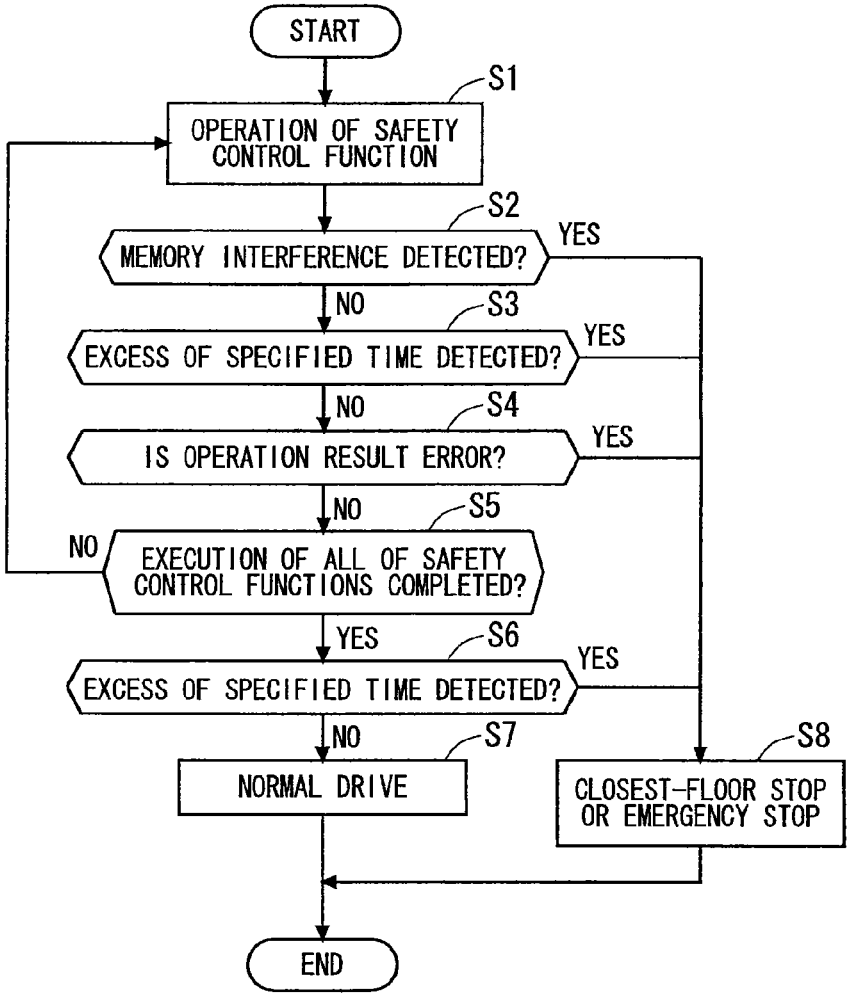
FIG. 7 is a flowchart for explaining the operation of the elevator safety control device 25 according to the first embodiment.

In the flowchart of FIG. 7, after completion of computation of each of safety control functions (steps S2 and S3), the independence assurance unit 36 determines whether each of the computation results shows "error" or not (step S4). Alternatively, after completion of computation of all of the safety control functions, the independence assurance unit 36 may obtain and determine which one of all of computation results shows "error".

As described above, the elevator safety control device 25 according to the embodiment is provided with the independence assurance unit 36 assuring independence of the safety control functions such as the memory interference monitoring function and the execution time monitoring function.

Therefore, without exertion of the influence of one of the safety control functions to the other safety control functions, the single elevator safety control device (safety control substrate) 25 can be provided with the plurality of safety control functions. Thus, the cost on safety control of the elevator can be reduced, and installation and maintenance can be carried out easily.

In the embodiment, in the electronized elevator safety control device 25, necessary safety control functions are provided. Therefore, only by adding the safety control function software, the sensor 31, and the switch 30, a new safety control function can be added to the elevator safety control device 25.

In the elevator safety control device 25 according to the embodiment, at the time of execution of a safety control function, the independence assurance unit 36 obtains identification information indicative of the kind of the safety control function and address information indicating the region in the memory 37, to be accessed in the execution of the safety control function from the CPU 34. The independence assurance unit 36 compares the obtained information with the assignment table shown in FIG. 4 to monitor whether or not each of safety control functions accesses the region other than the allowed region in the memory 37.

Therefore, the elevator safety control device 25 can easily realize the memory interference monitoring function by the independence assurance unit 36.

In the elevator safety control device 25 according to the embodiment, the independence assuring unit 36 monitors whether the individual computation process time exceeds the specified time or not. The independence assurance unit 36 monitors whether the total computation process time exceeds the specified time or not.

Therefore, the elevator safety control device 25 can easily realize the execution time monitoring function by the independence assurance unit 36.

In the elevator safety control device 25 according to the embodiment, when the independence assurance unit 36 detects that the computation result is "error" in any one of the safety control functions, the elevator safety control device 25 stops the car 1.

Therefore, the elevator safety control device 25 can assure independence on the same output of a plurality of programs.

In the elevator safety control device 25 according to the embodiment, when it is detected that the computation result of any of the safety control functions shows "error" or when it is detected that independence among the safety control functions cannot be assured, the elevator safety control device 25 immediately stops the car 1.

Therefore, the elevator safety control device 25 can immediately shift the elevator to a safe state.

In the elevator safety control device 25 according to the embodiment, when it is detected that the computation result of any of the safety control functions shows "error" or when it is detected that independence among the safety control functions cannot be assured, the elevator safety control device 25 stops the car 1 at the closest floor.

Therefore, the elevator safety control device 25 can evacuate a passenger at the closest floor at the abnormal time of the elevator.

In the elevator safety control device 25 according to the embodiment, when the car 1 does not arrive at the closest floor within predetermined time, the car 1 can be emergency-stopped in a state where the car 1 does not arrive at the closest floor.

When the car 1 does not arrive at the closest floor within predetermined time, it means that there is some trouble in operation of the elevator device. Therefore, the elevator safety control device 25 can assure safety of the car 1 moving toward the closest floor.

Second Embodiment

In this embodiment, another mode of the memory interference monitoring function described in the first embodiment will be described. Therefore, the configuration and operation other than the memory interference monitoring function (the configuration and operation of the elevator device 100 and the elevator safety control device 25) of the second embodiment and those of the first embodiment are similar.

Figure 8:
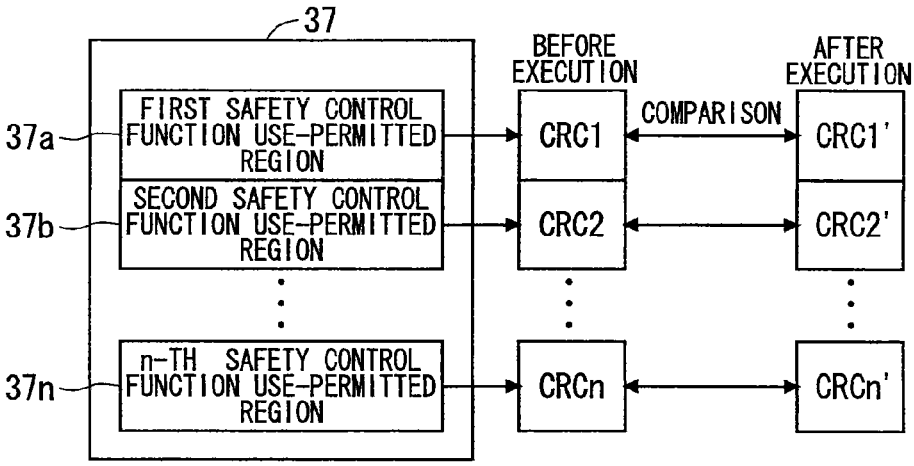
FIG. 8 is a diagram for explaining a memory interference monitoring function of the independence assurance unit 36 according to a second embodiment.

FIG. 8 is a diagram for explaining the memory interference monitoring function of the independence assurance unit 36 according to the second embodiment.

As described in the first embodiment, the memory 37 is divided into address regions to which accesses of respective safety control functions are permitted. For example, an address region to which access of a first safety control function is permitted is a first safety control function use-permitted region 37*a*. An address region to which access of a second safety control function is permitted is a second safety control function use-permitted region 37*b*. Similarly, an address region to which access of an n-th safety control function is permitted is an n-th safety control function use-permitted region 37*n*.

First, the independence assurance unit 36 according to the embodiment preliminarily calculates error detection codes CRC1, CRC2, . . . , and CRCn for the corresponding safety control function use-permitted regions 37*a*, 37*b*, . . . , and 37*n*, respectively. Specifically, the independence assurance unit 36 calculates the error detection codes CRC1, CRC2, . . . , and CRCn before execution of computation of the safety control functions. The error detection codes calculated before execution of the computation will be referred to as first error detection codes.

In the embodiment, a CRC (Cyclic Redundancy Code) is used as the error detection code (similarly as a second error detection code which will be described later).

Next, after completion of computation of a predetermined safety control function, the independence assurance unit 36 calculates again error detection codes CRC1', CRC2', . . . , and CRCn' for the safety control function use-permitted regions 37*a*, 37*b*, . . . , and 37*n*, respectively. The error detection codes calculated after execution of the computation will be referred to as second error detection codes.

As described above, the independence assurance unit 36 calculates the first error detection codes CRC1, CRC2, . . . , and CRCn and the second error detection codes CRC1', CRC2', . . . , and CRCn' in correspondence with the safe control function use-permitted regions 37*a*, 37*b*, . . . , and 37*n*.

In correspondence with the safety control function use-permitted regions 37*a*, 37*b*, . . . , and 37*n*, the independence assurance unit 36 compares the first error detection codes CRC1, CRC2, . . . , and CRCn with the second error detection codes CRC1', CRC2', . . . , and CRCn', respectively. Specifically, the independence assurance unit 36 compares the first error detection code CRC1 with the second error detection codes CRC1', compares the second error detection code CRC2 with the second error detection code CRC2', and compares the first error detection code CRCn with the second error detection code CRCn'.

It is assumed that, in execution of computation of a predetermined safety control function, the predetermined safety control function accesses the safety control function use-permitted regions 37*a*, 37*b*, . . . , and 37*n* to which the predetermined safety control function is not permitted to access. In this case, the error detection codes for the safety control function use-permitted regions 37*a*, 37*b*, . . . , and 37*n* other than the permitted region change before and after execution of computation of the safety control function.

Therefore, when the independence assurance unit 36 detects the second error detection codes CRC1', CRC2', . . . , and CRCn' different from the first error detection codes CRC1, CRC2, . . . , and CRCn by the error detection code comparing process, the independence assurance unit 36 determines the presence of memory interference. As described above, when the independence assurance unit 36 detects the presence of memory interference, the elevator safety control device 25 stops the car 1 in any of the above-described modes ("YES" in step S2 and refer to step S8 in FIG. 7).

The operation is executed each time after and before computation of each of the safety control functions. Completion of execution of a predetermined safety control function is found when a change in the process ID notified from the CPU 34 is detected by the independence assurance unit 36 or a measurement stop signal for the watchdog timers WDT1, WDT2, . . . , and WDTn corresponding to the safe control functions is detected by the independence assurance unit 36.

As described above, in the elevator safety control device 25 according to the embodiment, the independence assurance unit 36 compares the first error detection codes CRC1, CRC2, . . . , and CRCn with the second error detection codes CRC1', CRC2', . . . , and CRCn', respectively, for the safety control function use-permitted regions 37*a*, 37*b*, . . . , and 37*n*. Specifically, the independence assurance unit 36 according to the embodiment monitors whether any safety control function accesses the memory 37 other than the permitted regions or not by the comparing process (memory interference monitoring function).

Therefore, the elevator safety control device 25 can easily realize the memory interference monitoring function of the independence assurance unit 36.

Although the CRC is used as the error detection code, obviously, when other error detection codes are used, similar effects are obtained.

Third Embodiment

In the memory interference monitoring function of the first embodiment, each of the safety control functions only monitors whether an address in the memory 37 other than an address to which access of itself is permitted is accessed or not. That is, the memory interference monitoring function of the first embodiment is executed by using the assignment table shown in FIG. 4, the process ID, and the address information.

The embodiment is characterized in that the memory interference monitoring function is executed using an assignment table to which access right information is added and "process ID, address information, and access mode information". The configuration and operation other than the memory interference monitoring function (the configuration and operation of the elevator device 100 and the elevator safety control device 25) in the first embodiment and those in the third embodiment are similar.

FIG. 9 is a diagram for explaining the memory interference monitoring function of the independence assurance unit 36 according to this embodiment. In other words, FIG. 9 is a diagram showing an example of the assignment table according to the embodiment.

FIG. 9 shows conversion between a real address and a logical address for the memory 37. That is, in the example of FIG. 9, a logical address used when the CPU 34 accesses is written in correspondence with a real address in the memory 37.

In the example of FIG. 9, to real addresses R1, R2, and R3 (logical addresses L1, L2, and L3), an access of the safety control function having the process ID "1" is permitted. To real addresses R4, R5, R6, and R7 (logical addresses L4, L5, L6, and L7), an access of the safety control function having the process ID "2" is permitted. To real addresses R8 and R9 (logical addresses L8 and L9), an access of the safety control function having the process ID "3" is permitted. To a real address Rmm (logical address Lmm), an access of the safety control function having the process ID "n" is permitted.

In the example of FIG. 9, to a real address R10 (logical address L10), an access of any of the safety control functions is prohibited.

Further, to the assignment table according to the embodiment, different from the assignment table of FIG. 4, the "access right" information is also added. In the example of FIG. 9, for an access to the real address R1 (logical address L1) having the process ID "1", only an access mode of "read" is permitted. In other words, in the example of FIG. 9, an access mode of "write" to the real address R1 (logical address L1) having the process ID "1" is prohibited.

Similarly, in the example of FIG. 9, for an access to the real address R4 (logical address L4), only a mode of an access "write" is permitted. In other words, in the example of FIG. 9, to the real address R4 (logical address L4) having the process ID "2", an access mode of "read" is prohibited.

Similarly, in the example of FIG. 9, for an access to the real address Rmm (logical address Lmm) having the process ID "n", both of the access modes "read" and "write" are permitted.

In the embodiment, the elevator safety control device 25 holds the assignment table shown in FIG. 9. The CPU 34 executing computation of a predetermined safety control function accesses to a predetermined address in a predetermined access mode in the memory 37 via the independence assurance unit 36. Consequently, the independence assurance unit 36 can obtain not only "process ID and address information" described in the first embodiment but also "access mode information" of the CPU 34 to the memory 37.

In the independence assurance unit 36 according to the embodiment, the memory interference monitoring function is executed by using the assignment table shown in FIG. 9 and the "process ID, address information, and address mode information" obtained from the CPU 34. Concretely, the independence monitoring unit 36 monitors not only whether a safety control function accesses the memory 37 other than the permitted region or not but also whether the safety control function accesses the memory 37 in an access mode other than the permitted access right.

It is assumed that the independence assurance unit 36 detects an access in an access mode different from permitted access right information at the time of accessing an address in the memory 37 to which a predetermined safety control function is permitted. This case corresponds to a case where the independence assurance unit 36 detects the presence of memory interference. In this case, the elevator safety control device 25 stops the car 1 in any of the above-described modes ("YES" in step S2 and refer to step S8 in FIG. 7).

When the independence assurance unit 36 detects an access of an address in the memory 37 other than the permitted address from a predetermined safety control function, it is as described in the first embodiment.

As described above, in the elevator safety control device 25 according to the embodiment, also in the case where the independence assurance unit 36 detects an access mode to the memory 37 different from the access right information at the time of execution of computation of a predetermined safety control function, the elevator safety control device 25 stops the car 1.

Therefore, the elevator safety control device 25 according to the embodiment can provide the memory interference monitoring function having higher precision than the elevator safety control device 25 according to the first embodiment.

Fourth Embodiment

An elevator safety control device (safety control substrate) according to a fourth embodiment is different from the elevator safety control device 25 according to the first embodiment. The configuration of the entire elevator device 100 in the first embodiment and that in the fourth embodiment are the same (see FIG. 1).

In the first embodiment, one CPU 34, one independence assurance unit 36, and one memory 37 are disposed on the safety control substrate 25. On the other hand, in the fourth embodiment, two configuration groups each made of a CPU, an independence assurance unit, and a memory are disposed on a safety control substrate. That is, on the safety control substrate, the configuration group is doubly provided.

Figure 10:
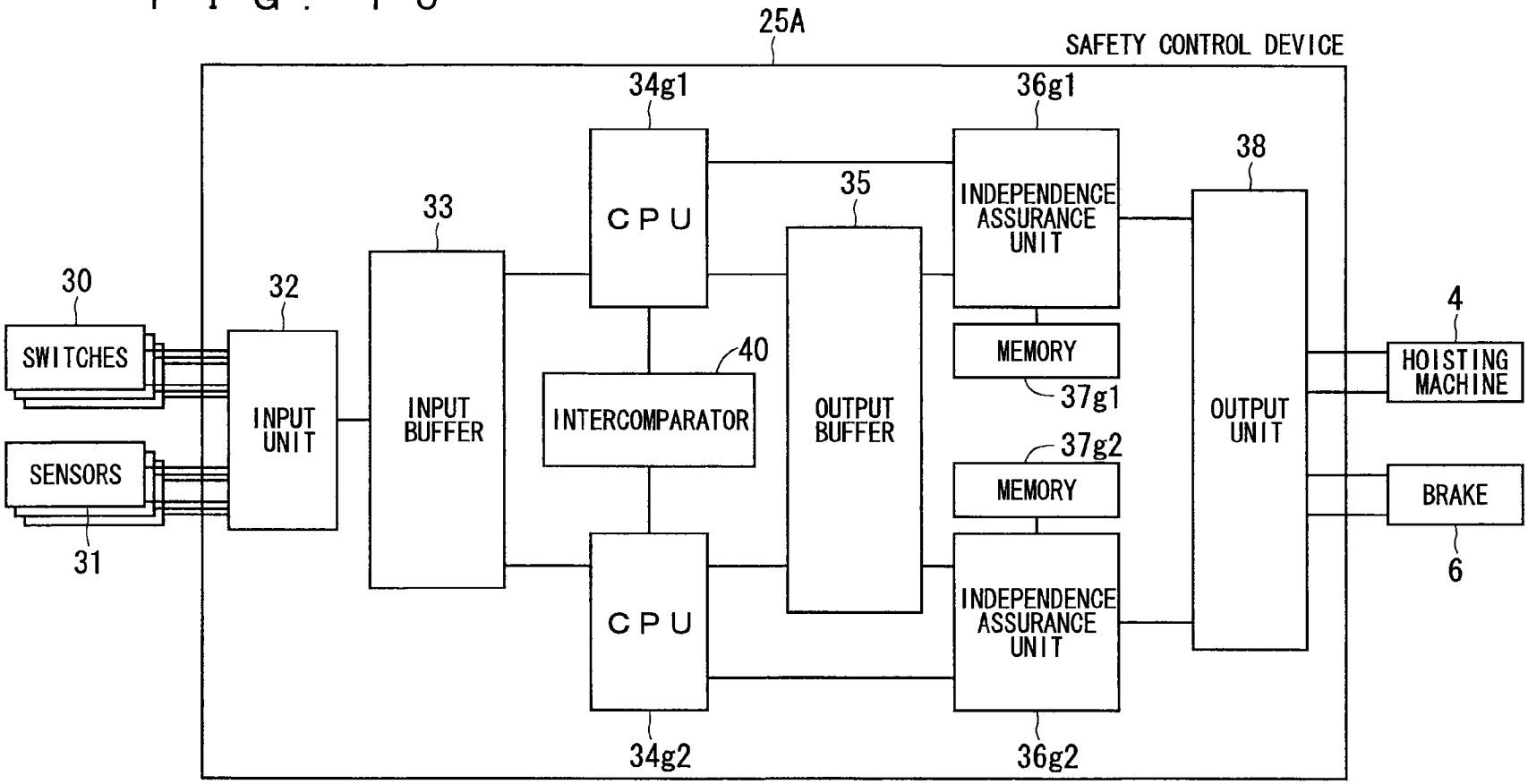
FIG. 10 is a block diagram showing the configuration of an elevator safety control device 25A according to a fourth embodiment.

FIG. 10 is a block diagram showing the configuration of a safety control device 25A according to the embodiment.

As shown in FIG. 10, on the elevator safety control device (safety control substrate) 25A, a first configuration group (called first system) made of a CPU 34*g*1, an independence assurance unit 36*g*1, and a memory 37*g*1 and a second configuration group (called second system) made of a CPU 34*g*2, an independence assurance unit 36*g*2, and a memory 37*g*2 are disposed.

The operation of each of the CPUs 34*g*1 and 34*g*2, each of the independence assurance units 36*g*1 and 36*g*2, and each of the memories 37*g*1 and 37*g*2 is the same as that of the CPU 34, the independence assurance unit 36, and the memory 37 described in the first to third embodiments. That is, also in the independence assurance units 36*g*1 and 36*g*2, in relation to the CPUs 34*g*1 and 34*g*2 and the memories 37*g*1 and 37*g*2, the memory interference monitoring function, the execution time monitoring function, further, the computation result error detecting operation, and the like described in the first to third embodiments are executed.

In the embodiment, each of the independence assurance units 36*g*1 and 36*g*2 determines match/mismatch of programs executed in the systems, which will be described later (execution program monitoring function). The independence assurance units 36*g*1 and 36*g*2 send notification of results of the execution program monitoring function to the CPUs 34*g*1 and 34*g*2, respectively.

Further, as shown in FIG. 10, an intercomparator 40 is disposed on the safety control substrate 25A according to the embodiment. The intercomparator 40 intercompares between the computation result of the CPU 34*g*1 and the computation result of the CPU 34*g*2.

The configuration and operation of the other blocks 32, 33, 35, and 38 are the same as those of the blocks indicated by the same reference numerals as those in FIG. 2 of the first embodiment.

In FIG. 10, the input unit 32 is connected to the input buffer 33, and the input buffer 33 is connected to each of the CPUs 34*g*1 and 34*g*2. The intercomparator 40 is disposed between the CPU 34*g*1 and CPU 34*g*2. Both of the CPUs 34*g*1 and 34*g*2 are connected to the output buffer 35. The CPU 34*g*1 is connected to the independence assurance unit 36*g*1, and the CPU 34*g*2 is connected to the independence assurance unit 36*g*2. The independence assurance unit 36*g*1 is connected to each of the output buffer 35, the memory 37*g*1, and the output unit 38. The independence assurance unit 36*g*2 is connected to each of the output buffer 35, the memory 37*g*2, and the output unit 38. The input unit 32 is connected to each of the external components (switch 30 and sensor 31) of the safety control substrate 25A, and the output unit 38 is connected to each of the external components (hoisting machine 4 and brake 6) of the safety control substrate 25A.

Figure 11:
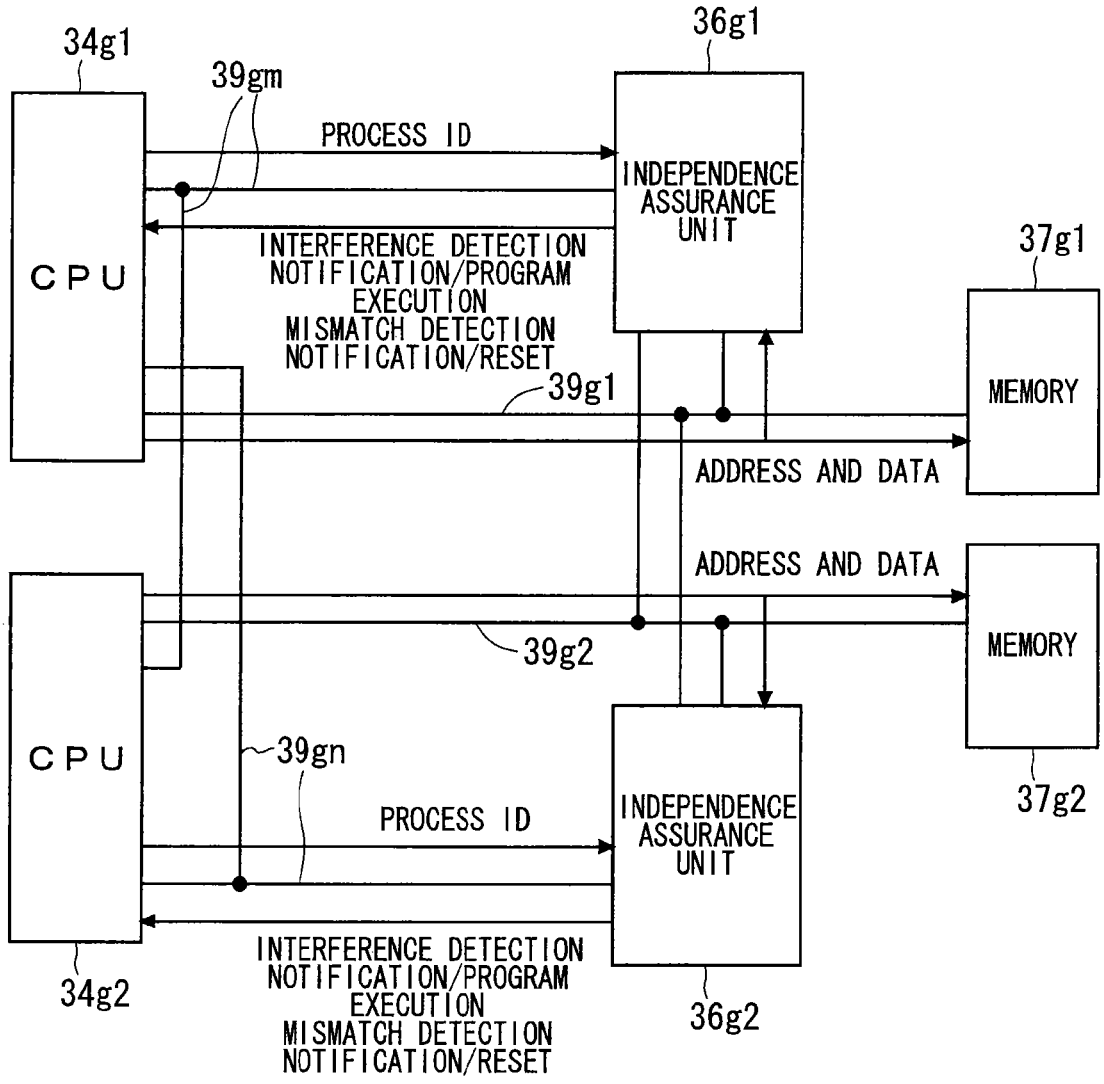
FIG. 11 is a diagram showing connection relations of CPUs 34*g*1 and 34*g*2, independence assurance units 36*g*1 and 36*g*2, and memories 37*g*1 and 37*g*2 in the fourth embodiment.

FIG. 11 is a block diagram showing connection relations of the independence assurance units 36*g*1 and 36*g*2, the CPUs 34*g*1 and 34*g*2, and the memories 37*g*1 and 37*g*2.

As shown in FIG. 11, the CPU 34*g*1 and the memory 37*g*1 are connected to each other via a bus 39*g*1, and the independence assurance units 36*g*1 and 36*g*2 are interposed in the bus 39*g*1. The CPU 34*g*2 and the memory 37*g*2 are connected to each other via a bus 39*g*2, and the independence assurance units 36*g*1 and 36*g*2 are interposed in the bus 39*g*2. The independence assurance units 36*g*1 and the CPUs 34*g*1 and 34*g*2 are mutually connected via a communication line 39*gm*. Further, the independence assurance units 36*g*2 and the CPUs 34*g*1 and 34*g*2 are mutually connected via a communication line 39*gn*.

As shown in FIG. 11, between the first and second systems, by disposition of the buses 39*g*1 and 39*g*2 and the signal lines 39*gm* and 39*gn*, data such as various signals and information can be shared. Specifically, the CPU 34*g*1 and the independence assurance unit 36*g*1 in the first system can obtain not only data transmitted/received in the first system but also data transmitted/received in the second system. Similarly, the CPU 34*g*2 and the independence assurance unit 36*g*2 in the second system can obtain not only data transmitted/received in the second system but also data transmitted/received in the first system.

For example, the CPU 34*g*1 notifies the independence assurance unit 36*g*1 and the CPU 34*g*2 of the process ID of a safety control function currently executing computation in the CPU 34*g*1 via the communication line 39*gm*. The CPU 34*g*2 notifies the independence assurance unit 36*g*2 and the CPU 34*g*1 of the process ID of a safety control function currently executing computation in the CPU 34*g*2 via the communication line 39*gn*.

The independence assurance unit 36*g*1 notifies the CPUs 34*g*1 and 34*g*2 of determination results of the independence assurance unit 36*g*1 (as an example, a memory interference monitoring result, an execution time monitoring result, and an execution program monitoring result) and instructions (for example, a reset process instruction) via the signal line 39*gm*. The independence assurance unit 36*g*2 notifies the CPUs 34*g*1 and 34*g*2 of determination results of the independence assurance unit 36*g*2 (as an example, a memory interference monitoring result, an execution time monitoring result, and an execution program monitoring result) and instructions (for example, a reset process instruction) via the signal line 39*gn*.

The CPU 34*g*1 accesses a predetermined address in the memory 37*g*1 at the time of computation process of a safety control function. Data such as a computation process result of the CPU 34*g*1 is written in a predetermined address in the memory 37*g*1. Similarly, the CPU 34*g*2 accesses a predetermined address in the memory 37*g*2 at the time of computation process of a safety control function. Data such as a computation process result of the CPU 34*g*2 is written in a predetermined address in the memory 37*g*2.

Accompanying the operation, the independence assurance units 36*g*1 and 36*g*2 obtain address information and data of a program operated in the CPU 34*g*1 via the bus 39*g*1. The independence assurance units 36*g*1 and 36*g*2 obtain address information and data of a program operated in the CPU 34*g*2 via the bus 39*g*2.

Using the obtained address information and data, the independence assurance units 36*g*1 and 36*g*2 compare the address and data of a program presently executed in the own system with the address and data of a program executed in the other system. That is, the independence assurance units 36*g*1 and 36*g*2 determine whether the program executed in the own system and that executed in the other system match or not (execution program monitoring function).

It is assumed that, by the execution program monitoring function, the independence assurance units 36*g*1 and 36*g*2 detect mismatch of the programs executed in the CPUs 34*g*1 and 34*g*2 in the systems. In this case, the independence assurance units 36*g*1 and 36*g*2 notify the CPUs 34*g*1 and 34*g*2, respectively, belonging to the own systems of the fact that the program executed in the other system differs from the program executed in the own system. When the independence assurance units 36*g*1 and 36*g*2 detect the mismatch of the programs, the elevator safety control device 25A stops the car 1 in any of the modes described in the first embodiment.

In the CPUs 34g1 and 34g2, basically, computing process according to the same program is simultaneously executed. Each of the CPUs 34g1 and 34g2 outputs a computation result as a result of the computing process to the intercomparator 40.

The intercomparator 40 compares the received computation results. As described above, basically, the same computing process is executed in the CPUs 34g1 and 34g2, so that the computation results received by the intercomparator 40 are the same. However, it is assumed that, for some reason, the intercomparator 40 detects mismatch of the computation results as a result of the comparison. In this case, the elevator safety control device 25A stops the car 1 in any of the modes described in the first embodiment.

Operations until the stop of the car, based on the memory interference monitoring function and the execution time monitoring function are as described in the first to third embodiments.

Figure 12:
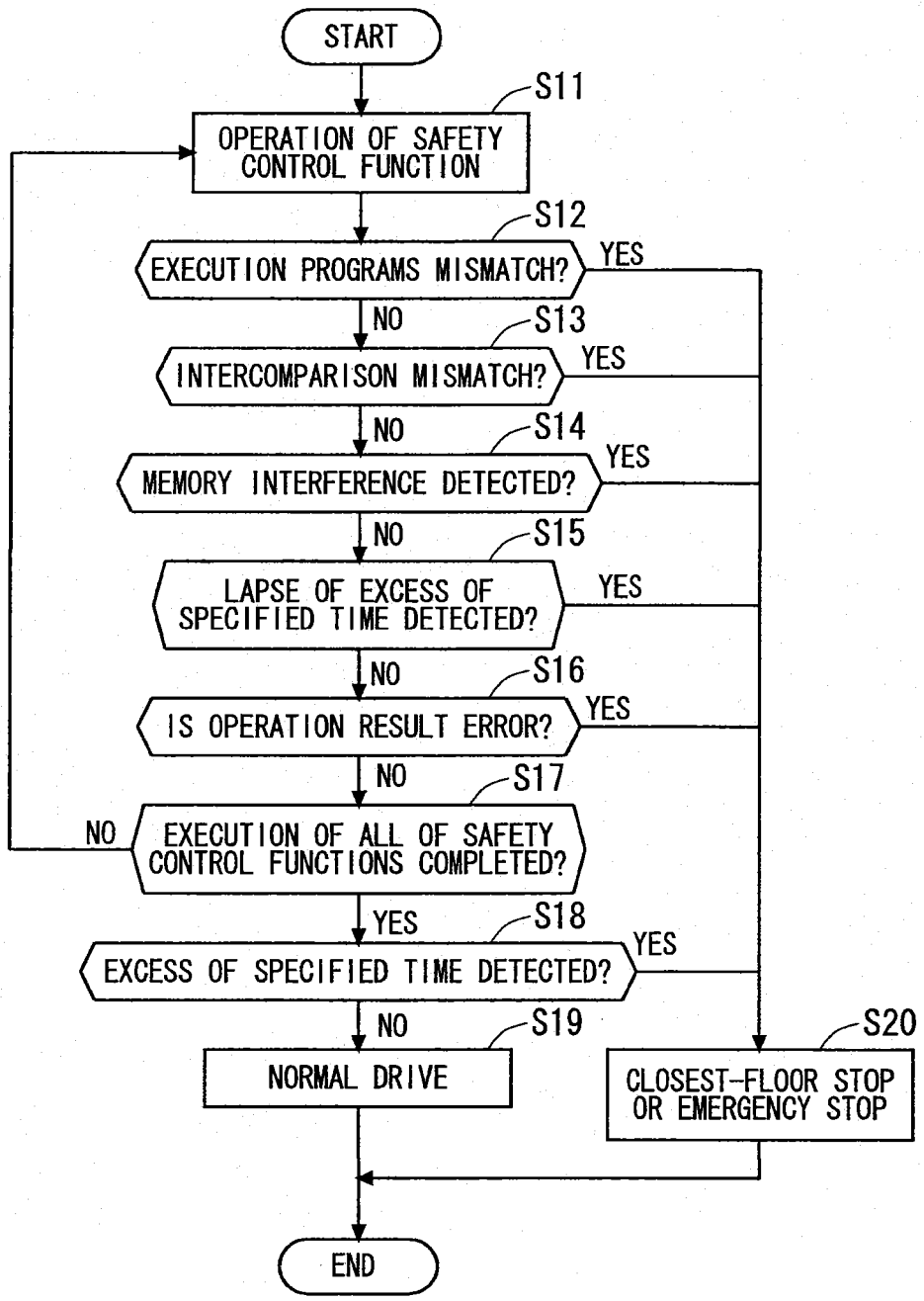
FIG. 12 is a flowchart for explaining the operation of the elevator safety control device 25A according to the fourth embodiment.

FIG. 12 is a flowchart showing the operation of the elevator safety control device 25A according to the embodiment. Using FIG. 12, hereinafter, the operation of the elevator safety control device 25A according to the embodiment will be described.

First, the CPUs 34g1 and 34g2 perform computation of a single predetermined safety control function (step S11). At the time of the computation, the independence assurance units 36g1 and 36g2 monitor match/mismatch of a program executed in the own system and a program executed in the other system by the execution program monitoring function (step S12).

It is assumed that any of the independence assurance units 36g1 and 36g2 detects mismatch of the programs executed ("YES" in step S12). In this case, the elevator safety control device 25A stops the car 1 in any of the above-described modes (step S20).

On the other hand, it is assumed that both of the independence assurance units 36g1 and 36g2 determine that the programs executed match ("NO" in step S12). In this case, the operation of the elevator safety control device 25A shifts to step S13.

In step S13, the intercomparator 40 compares computation results output from the CPUs 34g1 and 34g2. It is assumed that the intercomparator 40 detects mismatch of the received computation results ("YES" in step S13). In this case, the elevator safety control device 25A stops the car 1 in any of the above-described modes (step S20).

On the other hand, it is assumed that the intercomparator 40 detects match of the received computation results ("NO" in step S13). In this case, the elevator safety control device 25A shifts to the operation of the memory interference monitoring function.

The independence assurance units 36g1 and 36g2 monitor whether the independence of a safety control function is assured or not by the memory interference monitoring function (step S14). The operation in step S14 executed by each of the independence assurance units 36g1 and 36g2 is the same as that in step S2 in FIG. 7.

It is assumed that any of the independence assurance units 36g1 and 36g2 detects the presence of memory interference ("YES" in step S14). In this case, the elevator safety control device 25A stops the car 1 in any of the above-described modes (step S20).

On the other hand, it is assumed that both of the independence assurance units 36g1 and 36g2 determine the absence of memory interference ("NO" in step S14). In this case, each of the independence assurance units 36g1 and 36g2 makes determination by the operation of the execution time monitoring function (step S15).

In step S15, each of the independence assurance units 36g1 and 36g2 determines whether individual computation process time exceeds specified time. The operation in step S15 executed in each of the independence assurance units 36g1 and 36g2 is the same as that in step S3 in FIG. 7.

It is assumed that any of the independence assurance units 36g1 and 36g2 detects that computation of a predetermined safety control function is not finished within specified time ("YES" in step S15). In this case, the elevator safety control device 25A stops the car 1 in any of the above-described modes (step S20).

On the other hand, it is assumed that both of the independence assurance units 36g1 and 36g2 detect that computation of a predetermined safety control function is finished within specified time ("NO" in step S15). In this case, the operation of the elevator safety control device 25A shifts to step S16.

In step S16, the independence assurance units 36g1 and 36g2 monitor whether a computation result of a predetermined safety control function stored in the output buffer 35 is a normal value or not. The operation in step S16 executed in each of the independence assurance units 36g1 and 36g2 is the same as that in step S4 in FIG. 7.

It is assumed that any of the independence assurance units 36g1 and 36g2 detects that the computation result is "error" (a result determined as "abnormal" from the viewpoint of safety of the elevator) ("YES" in step S16). In this case, the elevator safety control device 25A stops the car 1 in any of the above-described modes (step S20).

On the other hand, it is assumed that each of the independence assurance units 36g1 and 36g2 detects that the computation result is normal (a result determined as "normal" from the viewpoint of safety of the elevator) ("NO" in step S16). In this case, the elevator safety control device 25A determines whether the execution of computation of all of safety control functions provided has been finished or not (step S17).

In the case where computation of all of the safety control functions has not been completed ("NO" in step S17), the elevator safety control device 25A selects one of safety control functions which are not computed yet, and repeatedly executes the operation from step S11 on the selected safety control function.

On the other hand, in the case computation of all of the safety control functions is completed ("YES" in step S17), the independence assurance units 36g1 and 36g2 determine whether total computation process time exceeds specified time or not (step S18). The operation in step S18 executed by each of the independence assurance units 36g1 and 36g2 is the same as that in step S6 in FIG. 7.

It is assumed that any of the independence assurance units 36g1 and 36g2 detects computation of all of the safety control functions is not finished within specified time ("YES" in step S18). In this case, the elevator safety control device 25A stops the car 1 in any of the above-described modes (step S20).

On the other hand, it is assumed that both of the independence assurance units 36g1 and 36g2 detect that computation of all of the safety control functions is finished within specified time ("NO" in step S18). In this case, the normal operation of the elevator by the drive controller 24 is continued (step S19).

In the flowchart of FIG. 12, after completion of computation of each of the safety control functions (steps S11 to S15), whether each of computation results shows "error" or not is determined (step S16). Alternatively, after completion of computation of all of the safety control functions, it is also possible to obtain and determine which one of all of computation results shows "error".

As described above, to the elevator safety control device 25A according to the embodiment, in addition to the series of operations of FIG. 7, the execution program monitoring function process by the independence assurance units 36*g*1 and 36*g*2 and the computation result match/mismatch determining process in the intercomparator 40 are added.

Therefore, the reliability of the elevator safety control system of the embodiment can be made higher than that in the first embodiment.

In the connection relations shown in FIG. 11, the independence assurance units 36*g*1 and 36*g*2 mutually connect the signal lines 39*gm* and 39*gn* and the buses 39*g*1 and 39*g*2. However, in place of the configuration, a configuration such that a signal line is connected between the independence assurance units 36*g*1 and 36*g*2 so that various data and signals can be transmitted/received between the independence assurance units 36*g*1 and 36*g*2 can be also employed.

In the embodiment, the case where two configuration groups each made of the CPU, the memory, and the independence assurance unit are provided has been described (the first and second systems). Alternatively, a configuration of three or more configuration groups may be employed (a configuration having three or more systems is also possible). In this case as well, wiring connection so that data and signals can be shared among the systems is necessary, and the intercomparator 40 is connected to each of the CPUs. Also in the case of such a configuration, obviously, the effect of improvement in reliability of the elevator safety control system described in the embodiment is obtained.

DESCRIPTION OF REFERENCE SIGNS

1 car, 2 hoisting machine, 6 brake, 23 control board, 24 drive controller, 25, 25A elevator safety control device (safety control substrate), 30 switch, 31 sensor, 32 input unit, 33 input buffer, 34, 34*g*1, 34*g*2 CPU, 35 output buffer, 36, 36*g*1, 36*g*2 independence assurance unit, 37, 37*g*1, 37*g*2 memory, 38 output unit, 40 intercomparator

The invention claimed is:

1. An elevator safety control device controlling stop of a car, comprising:

an input unit receiving a signal on a state of an elevator as an input value;

a logic unit including a CPU (Central Processing Unit) performing computation on safety control of said elevator by executing computation on a plurality of safety control functions by independent programs by using said input value, and a memory; and an independence assurance unit assuring independence of said safety control functions so that said safety control functions do not exert influence on one another, wherein said independence assurance unit assures independence of each of said safety control functions by monitoring whether or not said safety control functions access said memory other than a permitted region, and when said independence assurance unit detects an access to said memory other than the permitted region by a predetermined one of said safety control functions, said elevator safety control device stops said car.

2. The elevator safety control device according to claim 1, wherein said independence assurance unit assures independence of said safety control functions by monitoring whether or not computation process time of said safety control functions exceeds preset specified time and when said independence assurance unit detects that said computation process time exceeds said specified time, said elevator safety control device stops said car.

3. The elevator safety control device according to claim 1, wherein a plurality of said logic units are provided, each of said logic units performs the same computation process and output operation results as results of the computation process, said elevator safety control device further comprises an intercomparator comparing said computation results output from said logic units, and when said intercomparator detects mismatch of said computation results, said elevator safety control device stops said car.

4. The elevator safety control device according to claim 2, wherein a plurality of said logic units are provided, each of said logic units performs the same computation process and output operation results as results of the computation process, said elevator safety control device further comprises an intercomparator comparing said computation results output from said logic units, and when said intercomparator detects mismatch of said computation results, said elevator safety control device stops said car.

5. The elevator safety control device according to claim 3, wherein when said independence assurance unit detects that execution of a program in one of said logic units and execution of a program in another one of said logic units do not match, said elevator safety control device stops said car.

6. The elevator safety control device according to claim 4, wherein when said independence assurance unit detects that execution of a program in one of said logic units and execution of a program in another one of said logic units do not match, said elevator safety control device stops said car.

7. The elevator safety control device according to claim 1, wherein data indicative of an address in said memory to which an access is permitted to each of said safety control functions is held by each of said safety control functions, and said independence assurance unit (A-1) obtains, from said CPU, identification information indicative of the kind of the safety control functions and address information indicating a region in said memory, to be accessed in execution of the safety control functions at the time of execution of said safety control function, and (A-2) compares information obtained in said (A-1) with said data, thereby monitoring whether or not each of said safety control functions accesses said memory other than the permitted region.

8. The elevator safety control device according to claim 7, wherein said data includes access right information indicative of an access mode permitted to said memory of a predetermined one of said safety control functions, and when said independence assurance unit detects an access mode to said memory, different from said access right information to which said predetermined one of said safety control functions is permitted at the time of execution of said predetermined one of said safety control functions, said elevator safety control device stops said car.

9. The elevator safety control device according to claim 1, wherein a region permitted to be used in said memory is divided in correspondence with said safety control functions, and said independence assurance unit (A-1) calculates a first error detection code for each of said regions before execution of said safety control functions, (A-2) calculates a second error detection code for each of said regions after execution of said safety control functions, and (A-3) compares said first error detection code and said second error detection code with each other for each of said regions, thereby monitoring whether or not each of said safety control functions accesses said memory other than the permitted region.

10. The elevator safety control device according to claim 9, wherein said first and second error detection codes are CRCs (Cyclic Redundancy Codes).

11. The elevator safety control device according to claim 2, wherein said independence assurance unit monitors whether or not individual computation process time exceeds said specified time for each of said safety control functions, and when said independence assurance unit detects that said individual computation process time exceeds said specified time in any one of said safety control functions, said elevator safety control device stops said car.

12. The elevator safety control device according to claim 2, wherein said independence assurance unit monitors whether or not total computation process time of all of said safety control functions exceeds said specified time, and when said independence assurance unit detects that said total computation process time exceeds said specified time, said elevator safety control device stops said car.

13. The elevator safety control device according to claim 1, wherein when said independence assurance unit detects that a result of computation of any one of said safety control functions is "error", said elevator safety control device stops said car.

14. The elevator safety control device according to claim 2, wherein when said independence assurance unit detects that a result of computation of any one of said safety control functions is "error", said elevator safety control device stops said car.

15. The elevator safety control device according to claim 1, wherein said elevator safety control device immediately stops said car.

16. The elevator safety control device according to claim 2, wherein said elevator safety control device immediately stops said car.

17. The elevator safety control device according to claim 1, wherein said elevator safety control device stops said car at a closest floor.

18. The elevator safety control device according to claim 2, wherein said elevator safety control device stops said car at a closest floor.

19. The elevator safety control device according to claim 17, wherein when said car does not arrive at said closest floor within predetermined time, the elevator safety control device emergency-stops said car in a state where said car does not arrive at said closest floor.

20. The elevator safety control device according to claim 18, wherein when said car does not arrive at said closest floor within predetermined time, the elevator safety control device emergency-stops said car in a state where said car does not arrive at said closest floor.

21. The elevator safety control device according to claim 19, further comprising a timer in which said predetermined time can be changeably set, wherein said timer starts measuring in response to operation of said detection of said independence assurance unit, and the elevator safety control device emergency-stops said car after lapse of predetermined time since start of said measurement of said timer.

22. The elevator safety control device according to claim 20, further comprising a timer in which said predetermined time can be changeably set, wherein said timer starts measuring in response to operation of said detection of said independence assurance unit, and the elevator safety control device emergency-stops said car after lapse of predetermined time since start of said measurement of said timer.

23. The elevator safety control device according to claim 1, wherein said input unit, said logic unit, and said independence assurance unit are mounted on a single substrate.

24. The elevator safety control device according to claim 2, wherein said input unit, said logic unit, and said independence assurance unit are mounted on a single substrate.

25. An elevator safety control device controlling stop of a car, comprising:

an input unit receiving a signal on a state of an elevator as an input value;

a logic unit including a CPU (Central Processing Unit) performing computation on safety control of said elevator by executing computation on a plurality of safety control functions by each of independent programs by using said input value; and an independence assurance unit assuring independence of said safety control functions so that said safety control functions do not exert influence on one another, wherein said independence assurance unit assures independence of said safety control functions by monitoring whether or not computation process time of said safety control functions exceeds preset specified time, and when said independence assurance unit detects that said computation process time exceeds said specific time, said elevator safety control device stops said car.

26. The elevator safety control device according to claim 25, wherein a plurality of said logic units are provided, each of said logic units performs the same computation process and output operation results as results of the computation process, said elevator safety control device further comprises an intercomparator comparing said computation results output from said logic units, and when said intercomparator detects mismatch of said computation results, said elevator safety control device stops said car.

27. The elevator safety control device according to claim 26, wherein when said independence assurance unit detects that execution of a program in one of said logic units and execution of a program in another one of said logic units do not match, said elevator safety control device stops said car.

28. The elevator safety control device according to claim 25, wherein said independence assurance unit monitors whether or not individual computation process time exceeds said specified time for each of said safety control functions, and when said independence assurance unit detects that said individual computation process time exceeds said specified time in any one of said safety control functions, said elevator safety control device stops said car.

29. The elevator safety control device according to claim 25, wherein said independence assurance unit monitors whether or not total computation process time of all of said safety control functions exceeds said specified time, and when said independence assurance unit detects that said total computation process time exceeds said specified time, said elevator safety control device stops said car.

30. The elevator safety control device according to claim 25, wherein said elevator safety control device immediately stops said car.

31. The elevator safety control device according to claim 25, wherein said elevator safety control device stops said car at a closest floor.

32. The elevator safety control device according to claim 31, wherein when said car does not arrive at said closest floor within predetermined time, the elevator safety control device emergency-stops said car in a state where said car does not arrive at said closest floor.

33. The elevator safety control device according to claim 32, further comprising a timer in which said predetermined time can be changeably set, wherein said timer starts measuring in response to operation of said detection of said independence assurance unit, and the elevator safety control device emergency-stops said car after lapse of predetermined time since start of said measurement of said timer.

34. The elevator safety control device according to claim 25, wherein said input unit, said logic unit, and said independence assurance unit are mounted on a single substrate.

35. The elevator safety control device according to claim 25, wherein when said independence assurance unit detects that a result of computation of any one of said safety control functions is "error", said elevator safety control device stops said car.

* * * * *